US008869398B2

(12) United States Patent
Kent et al.

(10) Patent No.: US 8,869,398 B2
(45) Date of Patent: Oct. 28, 2014

(54) SYSTEM AND METHOD FOR MANUFACTURING A HEAT EXCHANGER

(75) Inventors: Victor Kent, Spartanburg, SC (US); Mykhaylo Sinkevych, Moscow (RU); Alexander Belokon, Moscow (RU); Vladimir Beschastnykh, Moscow (RU)

(73) Assignee: Thermo-Pur Technologies, LLC, Greenville, SC (US)

( * ) Notice: Subject to any disclaimer, the term of this patent is extended or adjusted under 35 U.S.C. 154(b) by 532 days.

(21) Appl. No.: 13/227,834

(22) Filed: Sep. 8, 2011

(65) Prior Publication Data

US 2013/0061474 A1 Mar. 14, 2013

(51) Int. Cl.
*B21D 53/02* (2006.01)
*B21D 53/04* (2006.01)

(52) U.S. Cl.
CPC ..... *B21D 53/04* (2013.01)
USPC ..... 29/890.03

(58) Field of Classification Search
CPC ..... F28D 9/02; B21D 53/02
USPC ..... 29/890.03, 890.039, 890.041, 890.042; 165/166
See application file for complete search history.

(56) References Cited

U.S. PATENT DOCUMENTS 2,957,679 A * 10/1960 Campbell ..... 165/148
3,056,189 A * 10/1962 Campbell ..... 29/890.042
3,458,917 A 8/1969 Mueller
3,911,843 A 10/1975 Stowell
3,920,175 A 11/1975 Hamilton et al.
3,927,817 A 12/1975 Hamilton et al.
4,011,905 A 3/1977 Millard
4,081,025 A 3/1978 Donaldson
4,327,802 A 5/1982 Beldam
4,700,774 A 10/1987 Schwarz
4,915,165 A 4/1990 Dahlgren et al.
5,016,805 A 5/1991 Cadwell
5,070,607 A * 12/1991 Boardman et al. ..... 29/890.042
5,385,204 A 1/1995 Boardman et al.
5,462,113 A 10/1995 Wand
5,505,256 A 4/1996 Boardman et al.
5,769,908 A 6/1998 Koppelman
5,884,696 A 3/1999 Loup
5,964,280 A 10/1999 Wehrmann et al.
5,988,269 A 11/1999 Karlsson et al.
6,016,864 A 1/2000 Bae et al.
6,142,221 A 11/2000 Johansson
6,164,371 A 12/2000 Bertilsson et al.
6,247,528 B1 6/2001 Blomgren et al.
6,336,987 B1 * 1/2002 Eriksson ..... 156/209

(Continued)

OTHER PUBLICATIONS

Written Opinion and Search Report PCT/US12/53024, dated Dec. 17, 2012.

*Primary Examiner* — Jacob Cigna
(74) *Attorney, Agent, or Firm* — Dority & Manning, P.A.

(57) ABSTRACT

A method for manufacturing a heat exchanger includes joining a first conductive sheet to a second conductive sheet to define a plurality of separate volumes in a blank envelope, creating an aperture in each separate volume in the blank envelope, and heating the blank envelope. The method further includes pressurizing each separate volume through the apertures, hot plastic forming the blank envelope into a formed envelope, and assembling a plurality of formed envelopes into a heat exchanger core, wherein the heat exchanger core includes a fluid passage outside of the formed envelopes, wherein the fluid passage is defined by adjacent formed envelopes, and wherein the fluid passage extends across a dimension of the heat exchanger core.

17 Claims, 8 Drawing Sheets

(56) References Cited

U.S. PATENT DOCUMENTS

| | | | | |
|---|---|---|---|---|
| 6,341,649 | B1 | 1/2002 | Joshi et al. | |
| 6,343,645 | B1 | 2/2002 | Baumann et al. | |
| 6,364,008 | B1 | 4/2002 | Mannoni et al. | |
| 6,378,603 | B1 | 4/2002 | Shimoya et al. | |
| 6,401,804 | B1 | 6/2002 | Shimoya et al. | |
| 6,510,894 | B1 * | 1/2003 | Watton et al. | 165/166 |
| 6,530,425 | B2 * | 3/2003 | Wehrmann et al. | 165/167 |
| 6,786,276 | B2 | 9/2004 | Samy et al. | |
| 6,918,433 | B2 | 7/2005 | Kontu | |
| 6,948,559 | B2 | 9/2005 | Reinke et al. | |
| 7,040,387 | B2 | 5/2006 | Leuthner et al. | |
| 7,140,425 | B2 | 11/2006 | Romero-Beltran | |
| 7,284,402 | B2 | 10/2007 | Friedman et al. | |
| 7,334,631 | B2 | 2/2008 | Kato et al. | |
| 7,416,105 | B2 | 8/2008 | Pitt et al. | |
| 7,451,907 | B2 | 11/2008 | Sigler et al. | |
| 7,703,505 | B2 | 4/2010 | So et al. | |
| 7,918,268 | B2 | 4/2011 | Oswald | |
| 2006/0124287 | A1 | 6/2006 | Reinders | |
| 2008/0029257 | A1 | 2/2008 | Nilsson | |
| 2008/0121382 | A1 | 5/2008 | So et al. | |
| 2008/0196873 | A1 | 8/2008 | Svensson | |
| 2008/0314574 | A1 * | 12/2008 | Filippi et al. | 165/167 |
| 2009/0120629 | A1 | 5/2009 | Ashe | |
| 2009/0133861 | A1 | 5/2009 | Kim | |
| 2010/0071887 | A1 | 3/2010 | Sugiyama et al. | |
| 2010/0175861 | A1 | 7/2010 | Ma et al. | |
| 2013/0062039 | A1 | 3/2013 | Kent et al. | |

* cited by examiner

SYSTEM AND METHOD FOR MANUFACTURING A HEAT EXCHANGER

FIELD OF THE INVENTION

The present invention generally involves a system and method for manufacturing a heat exchanger.

BACKGROUND OF THE INVENTION

Many types of heat exchangers exist for transferring heat between fluid systems. For example, a heat exchanger of some type is included in almost every power generation device, ventilation system, and water system used in the developed world, and virtually every automobile, truck, boat, aircraft, or other machine having a combustion engine, a pneumatic system, a hydraulic system, or other heat generating component includes at least one heat exchanger. In some applications, multiple heat exchangers may be used to exchange heat with multiple fluids, including air and gases. For example, an engine compartment of an automobile may include one heat exchanger to cool radiator fluid, a second heat exchanger to cool transmission fluid, and a third heat exchanger to cool refrigerant associated with an air conditioner. As another example, turbo diesel engine vehicles may include heat exchangers to cool and/or heat exhaust gases for better gas mileage or generation of electric power with a separate heat exchanger for an intercooler, exhaust gas recirculator, and/or turbo-electric generator. Larger vehicles may include additional heat exchangers to cool other hydraulic fluids, compressed air, or auxiliary systems. Each separate heat exchanger requires a separate footprint that occupies the finite available space in the engine compartment, increases manufacturing, assembly, and maintenance costs, and adds to the overall weight of the vehicle. In addition, many heat exchangers have a generally accepted best location identified where this cooling and/or heating should take place based on the general design considerations and/or velocity of the air flow for heat exchange.

The traditional technology for manufacturing efficient heat exchangers involves repeated stamping, annealing, and welding of conductive blanks to form plates or envelopes with complex corrugation patterns. The stretching associated with the stamping requires thicker conductive blanks than the ideal thickness for enhanced heat transfer. In addition, the annealing often requires maintaining the conductive blanks at elevated temperatures for extended periods which may lead to unwanted oxidation of the conductive blanks. As a result, the traditional technology is time consuming, expensive, and produces a heavier than ideal heat exchanger.

More recently, superplastic forming techniques have been used to manufacture heat exchangers. Specifically, the conductive blanks may be heated and then plastically deformed to the desired shape using a combination of pressure plates, dies, and/or high pressure gases. Although the superplastic forming techniques have reduced costs and time associated with manufacturing traditional heat exchangers, an improved system and method for manufacturing multiple fluid heat exchangers would be useful.

BRIEF DESCRIPTION OF THE INVENTION

Aspects and advantages of the invention are circuit forth below in the following description, or may be obvious from the description, or may be learned through practice of the invention.

One embodiment of the present invention is a method for manufacturing a heat exchanger that includes joining a first conductive sheet to a second conductive sheet to define a plurality of separate volumes in a blank envelope, creating an aperture in each separate volume in the blank envelope, and heating the blank envelope. The method further includes pressurizing each separate volume through the apertures, hot plastic forming the blank envelope into a formed envelope, and assembling a plurality of formed envelopes into a heat exchanger core, wherein the heat exchanger core includes a fluid passage outside of the formed envelopes, wherein the fluid passage is defined by adjacent formed envelopes, and wherein the fluid passage extends across a dimension of the heat exchanger core.

Another embodiment of the present invention is a method for manufacturing a heat exchanger that includes joining a first conductive sheet to a second conductive sheet to define a plurality of blank envelopes, wherein each blank envelope includes a plurality of separate volumes. The method further includes separating the blank envelopes, creating an aperture in each separate volume in each blank envelope, and heating the blank envelope. In addition, the method includes pressurizing each separate volume through the apertures, hot plastic forming each blank envelope into a formed envelope, and assembling a plurality of the formed envelopes into a heat exchanger core, wherein the heat exchanger core includes a fluid passage outside of the formed envelopes, wherein the fluid passage is defined by adjacent formed envelopes, and wherein the fluid passage extends across a dimension of the heat exchanger core.

Alternate embodiments of the present invention may also be a system for manufacturing a heat exchanger that includes means for joining a first conductive sheet to a second conductive sheet to define a plurality of separate volumes in a blank envelope, means for hot plastic forming the blank envelope into a formed envelope, and means for assembling a plurality of the formed envelopes into a heat exchanger core, wherein the heat exchanger core includes a fluid passage outside of the formed envelopes, wherein the fluid passage is defined by adjacent formed envelopes, and wherein the fluid passage extends across a dimension of the heat exchanger core.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
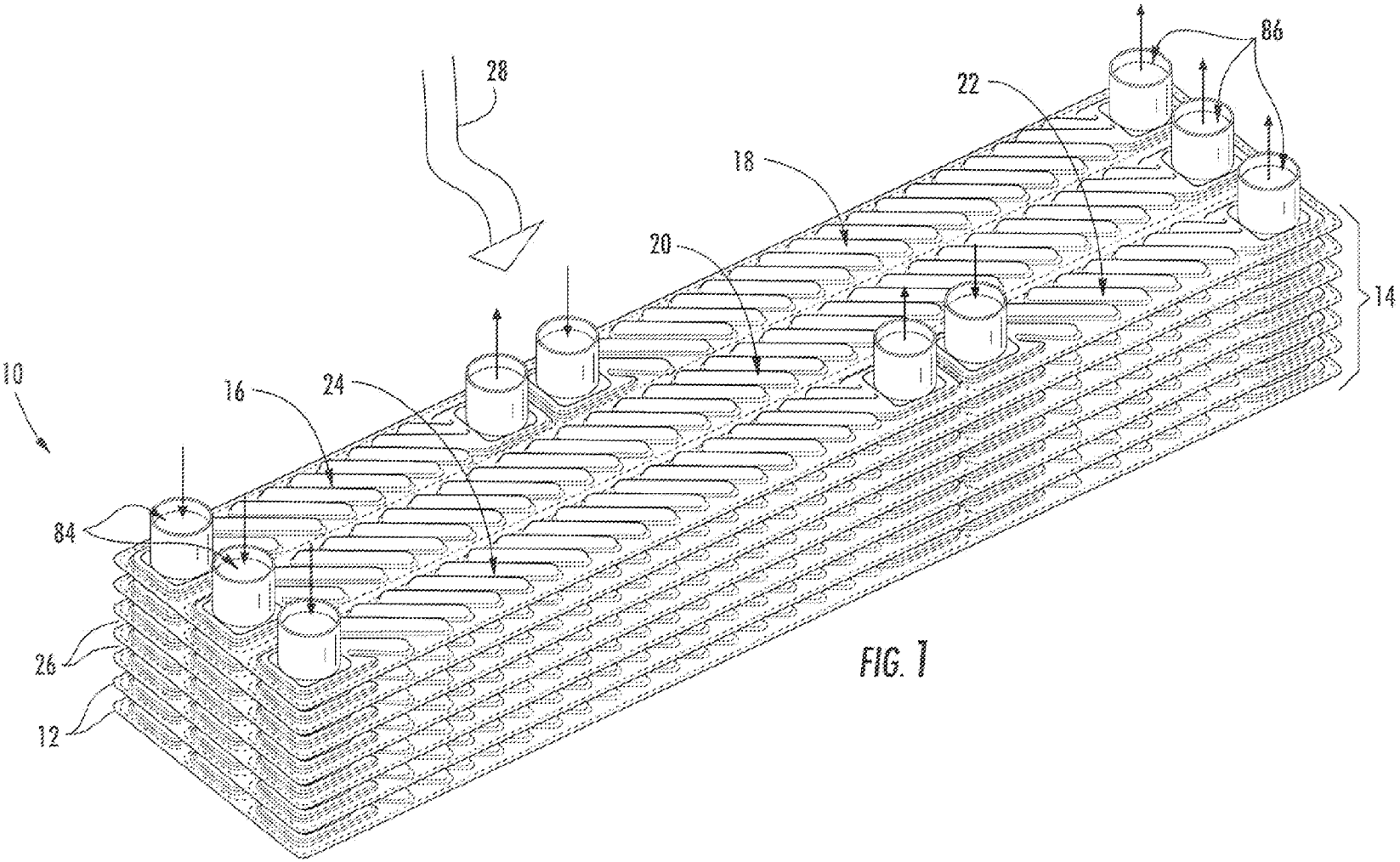
FIG. 1 is a perspective view of an exemplary heat exchanger manufactured according to various one embodiments of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention provide a system and method for manufacturing a heat exchanger. In particular embodiments of the present invention, the system and method combine traditional welding with hot plastic forming to assemble a multiple fluid heat exchanger. Although particular embodiments of the present invention may be described in the context of an automobile, truck, or other vehicle, one of ordinary skill in the art will readily appreciate that the present invention is not limited to any particular application and may be suitably adapted for use in any application requiring the transfer of heat between fluids.

FIG. 1 provides a perspective view of an exemplary heat exchanger 10 manufactured according to various one embodiments of the present invention. As shown, the heat exchanger 10 generally includes a plurality of envelopes 12 stacked on top of one another or arranged in layers to form a heat exchanger core 14. Each envelope 12 defines a plurality of volumes or cavities, and each volume or cavity includes an inlet and an outlet. For example, in the specific embodiment shown in FIG. 1, each envelope 12 defines five separate volumes 16, 18, 20, 22, 24.

Each volume has an associated inlet and outlet, indicated by the arrows in FIG. 1, to provide five separate pathways for five separate system fluids to flow into and through the heat exchanger core 14 concurrently.

As shown in FIG. 1, the layers of envelopes 12 define a fluid passage or channel 26 outside of and between adjacent envelopes 12. The multiple fluid passages or channels 26 extend across a dimension of the heat exchanger 10. In this manner, a flow of ambient fluid 28, such as air or water, may flow through the fluid passages or channels 26 and around the layers of envelopes 12 to exchange heat with the system fluids flowing through the envelopes 12. Additional details regarding the structure and operation associated with various embodiments of the heat exchanger 10 are described in a U.S. patent application entitled "System and Method for Exchanging Heat" filed on the same date as the present application, listing the same inventors as the present application, and assigned to the same assignee as the present application, the entirety of which is incorporated herein for all purposes.

Figure 2:
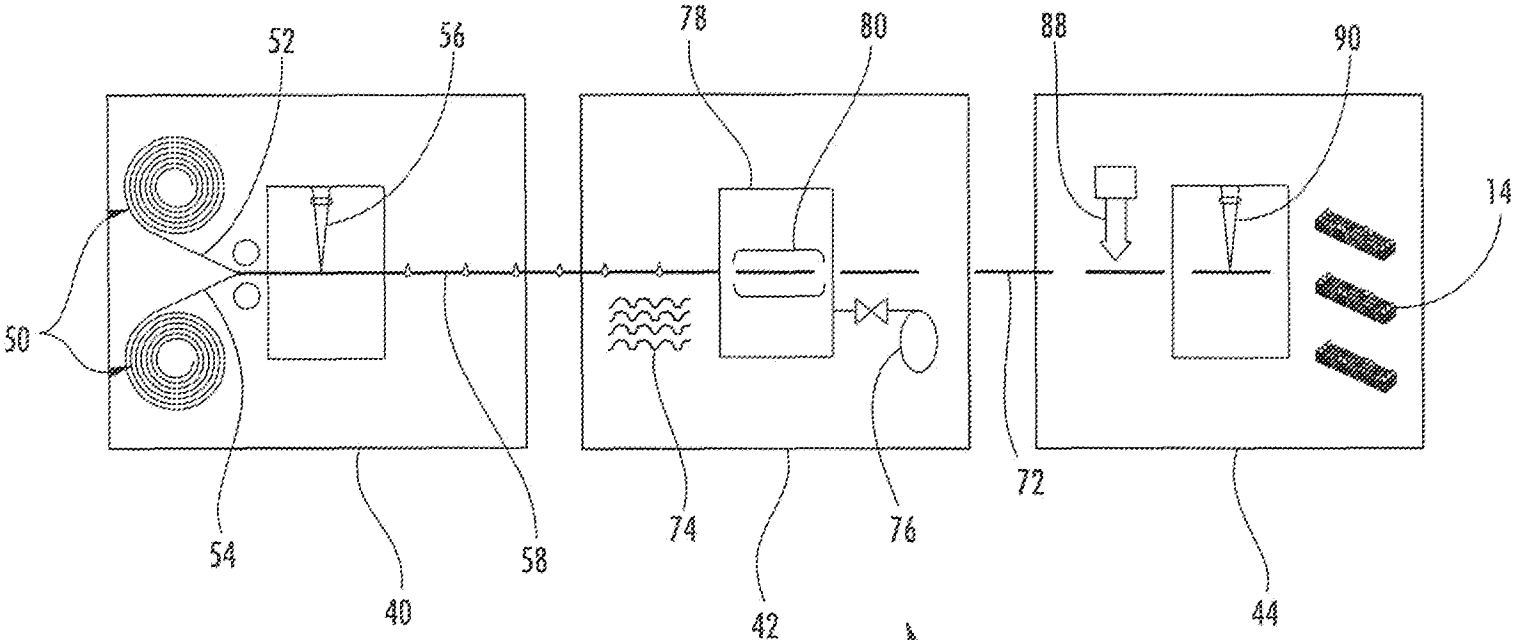
FIG. 2 is a block diagram of a system for manufacturing the heat exchanger shown in FIG. 1 according to one embodiment of the present invention.
Figure 3:
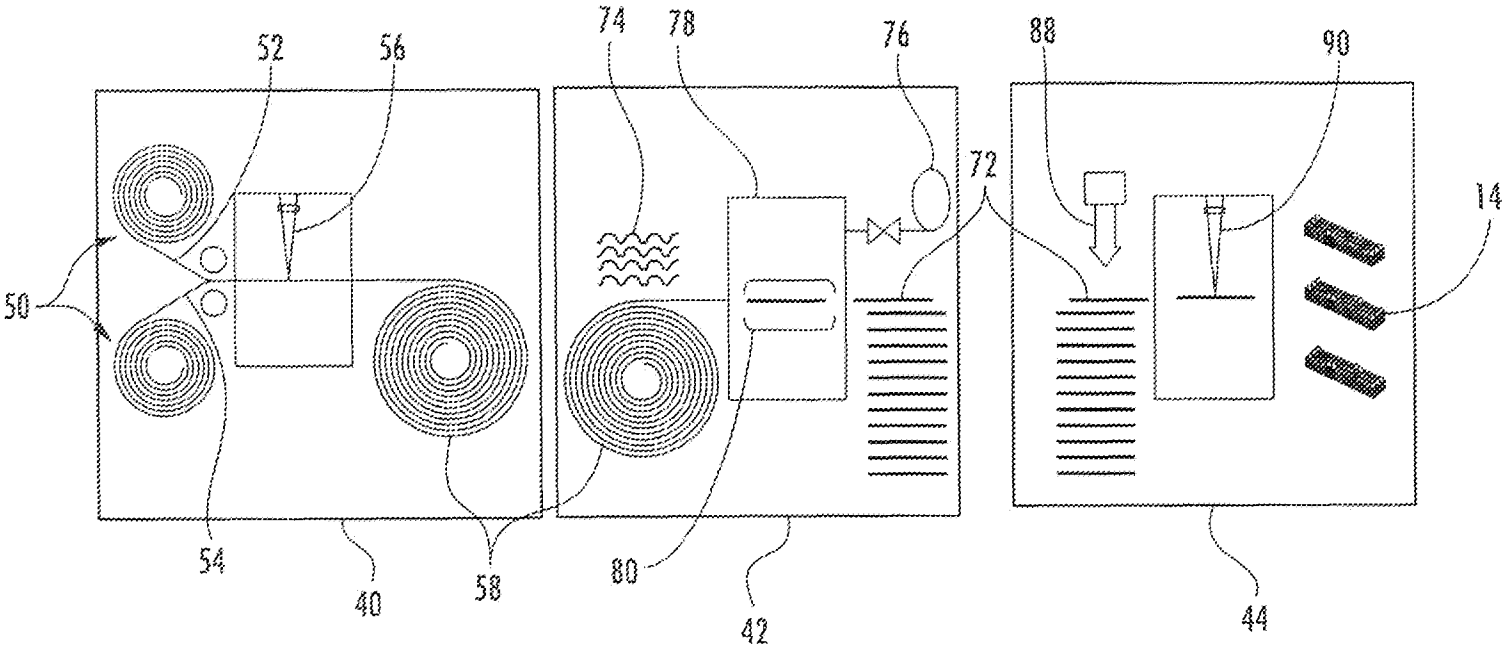
FIG. 3 is a block diagram of a system for manufacturing the heat exchanger shown in FIG. 1 according to an alternate embodiment of the present invention.

FIG. 2 provides a block diagram of a system 30 for manufacturing the heat exchanger 10 shown in FIG. 1 according to one embodiment of the present invention. The system 30 generally includes multiple stations that process a thermally conductive material to form blank envelopes, shape the blank envelopes, and assemble the shaped envelopes into the heat exchanger core 14. For example, as shown in FIG. 2, the system 30 may include a joining station 40, a forming station 42, and an assembling station 44. Although illustrated as sequential, connected stations in FIG. 2, one of ordinary skill in the art will readily appreciate that the stations may be separate and unconnected to allow for each station to perform batch operations independent and separate from the other stations. For example, FIG. 3 provides a block diagram of the system 30 for manufacturing the heat exchanger 10 shown in FIG. 1 in which the joining station 40, forming station 42, and assembling station 44 operate separately to perform batch operations independent of the other stations. In addition, although exemplary structure and functions of each station will be described herein, one of ordinary skill in the art will readily appreciate that the various structures and/or functions may be shared, combined, and/or otherwise arranged in different stations in particular embodiments, and the present invention is not limited to any particular grouping, arrangement, or sequence unless specifically recited in the claims.

The joining station 40 generally includes a supply of thermally conductive material 50 and means for joining a first conductive sheet 52 to a second conductive sheet 54. The supply of thermally conductive material 50 may include, for example, a roll of aluminum, copper, stainless steel, nickel, titanium, or other conductive metals, alloys, and superalloys suitable for use in the heat exchanger 10. The means for joining the first and second conductive sheets 52, 54 may include any suitable device known to one of ordinary skill in the art for fixedly connecting one conductive material to another. For example, the means for joining the first and second conductive sheets 52, 54 may include a friction stir welder, a fusion welder, or a laser welder 56. In other particular embodiments, the means for joining the first and second conductive sheets 52, 54 may include diffusion bonding equipment, soldering equipment, brazing equipment, or any combination of gaskets and fasteners that join the first and second conductive sheets 52, 54. As shown in FIGS. 2 and 3, the first and second conductive sheets 52, 54 may be separately supplied to the means for joining the first and second conductive sheets 52, 54, with the output being a sequential series of blank envelopes 58 with a plurality of separately defined volumes 60 in each blank envelope 58.

Figure 4:
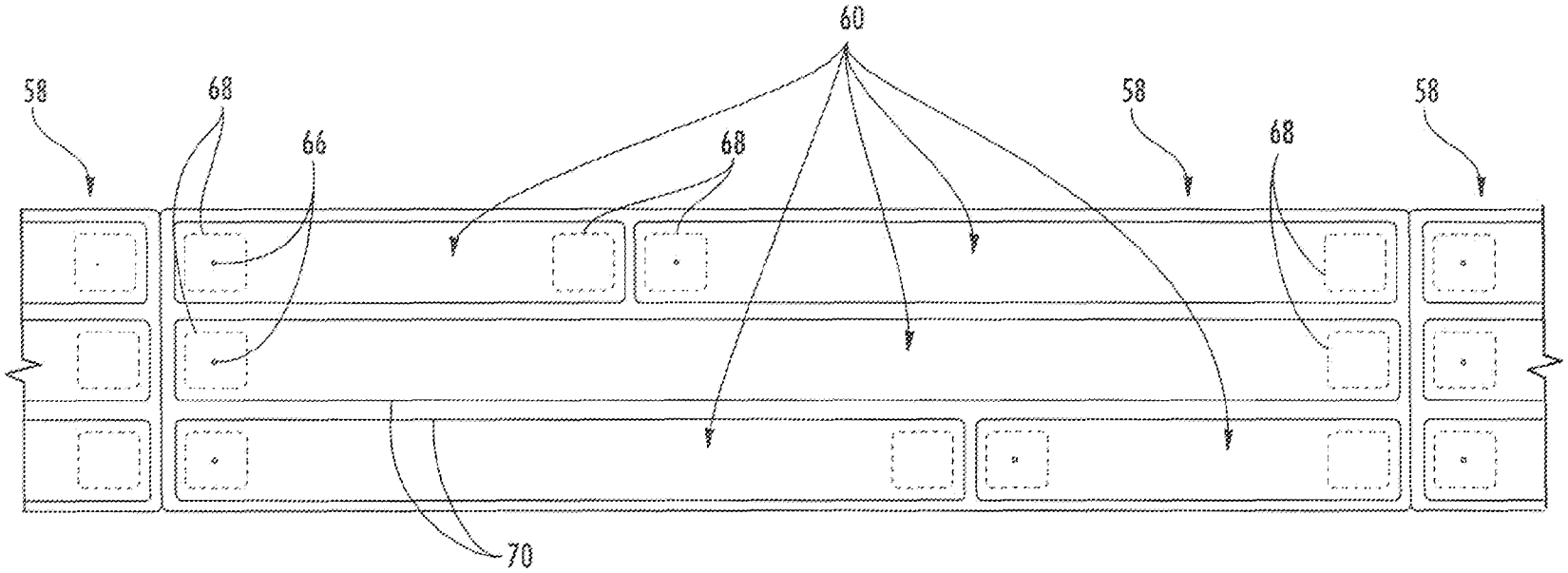
FIG. 4 is a top plan view of a blank envelope formed according to various embodiments of the present invention.
Figure 5:
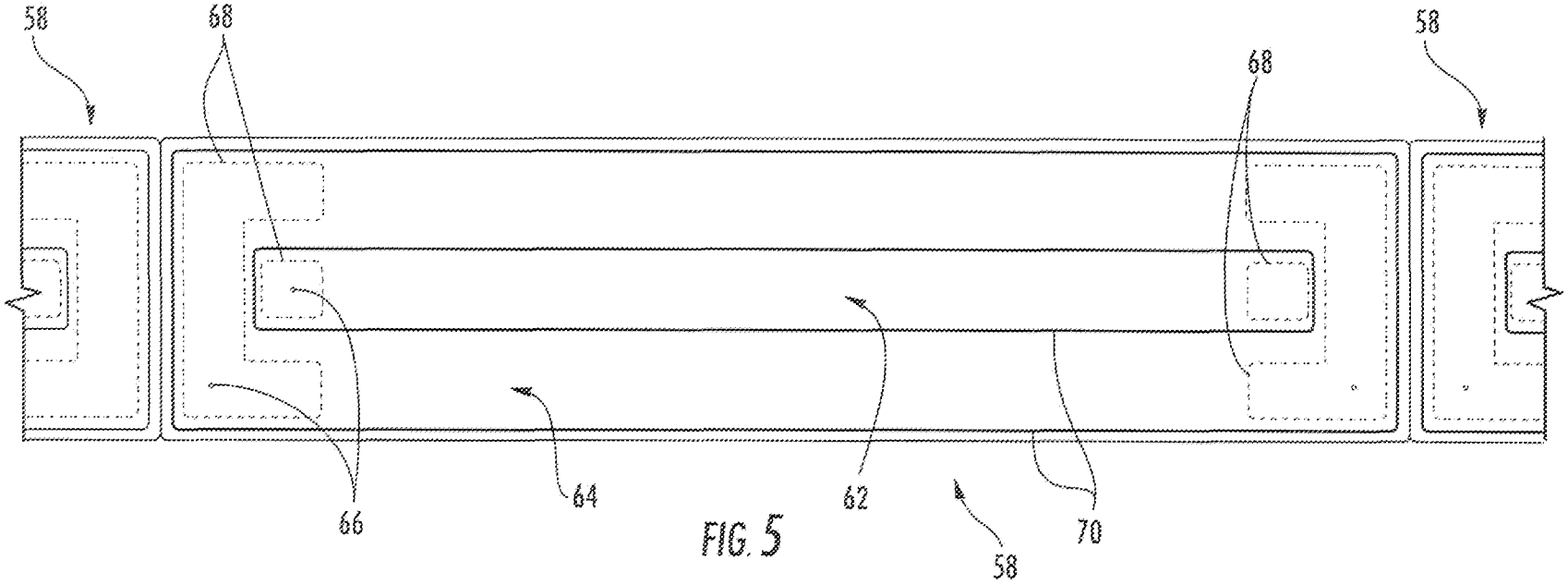
FIG. 5 a top plan view of an alternate blank envelope formed according to various embodiments of the present invention.

FIGS. 4 and 5 provide top plan views of blank envelopes 58 formed according to various embodiments of the present invention. As shown in FIG. 4, for example, the joining station 40 may create five separately defined volumes 60 in the blank envelope 58, with a weld bead, braze joint, gasket, or other impermeable barrier forming a seal 70 around each volume 60. Each separately defined volume 60 may be aligned parallel to or perpendicular to an anticipated flow through the fluid passage 26. Alternately, as shown in FIG. 5, the joining station 40 may create two separately defined volumes, with a first volume 62 completely surrounded by a second volume 64.

As shown in FIGS. 4 and 5, the joining station 40 or the forming station 42 may further create an aperture 66 in each separate volume 60 in the blank envelope 58. The apertures 66 may be generally located within the perimeter of a fluid channel 68 that will later be cut or otherwise formed through opposite ends of each separate volume 60. In this manner, the apertures 66 may provide fluid communication into each separate volume 60.

The forming station 42 shown in FIGS. 2 and 3 generally includes means for hot plastic forming the blank envelope 58 into a formed envelope 72. The means for hot plastic forming may include, for example, a heater 74, a supply of gas 76, a press 78, and/or a die 80. The heater 74 may include, for example, ceramic plates, induction coils, resistance coils, or other suitable devices known in the art for conductively, inductively, or radiantly heating the blank envelopes 58. The supply of gas 76 may be used to inject an inert or other gas through the aperture 66 associated with each separate volume 60 to pressurize each separate volume 60. The pressurized and heated blank envelopes 58 may then plastically deform to conform to the shape of the die 80. Alternately or in addition, a press 78 may be used to plastically deform the pressurized and/or heated blank envelopes 58 into the desired shape.

Figure 6:
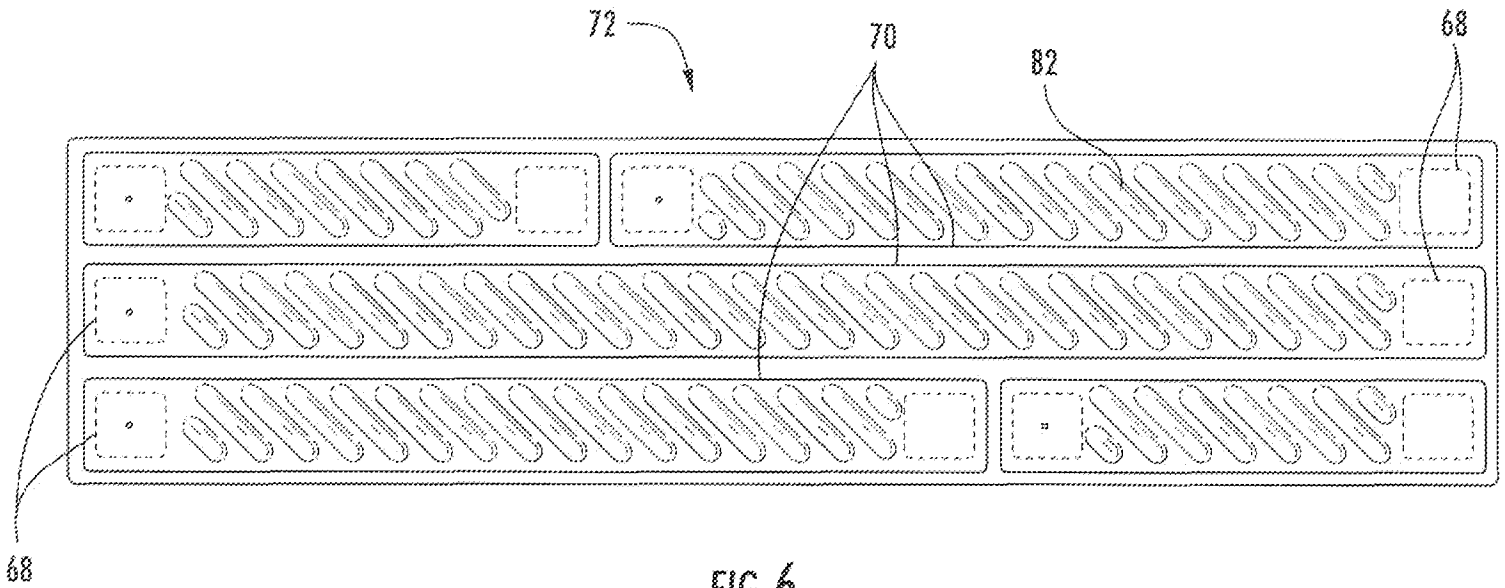
FIG. 6 is a plan view of the blank envelope shown in FIG. 4 shaped into a formed envelope.
Figure 7:
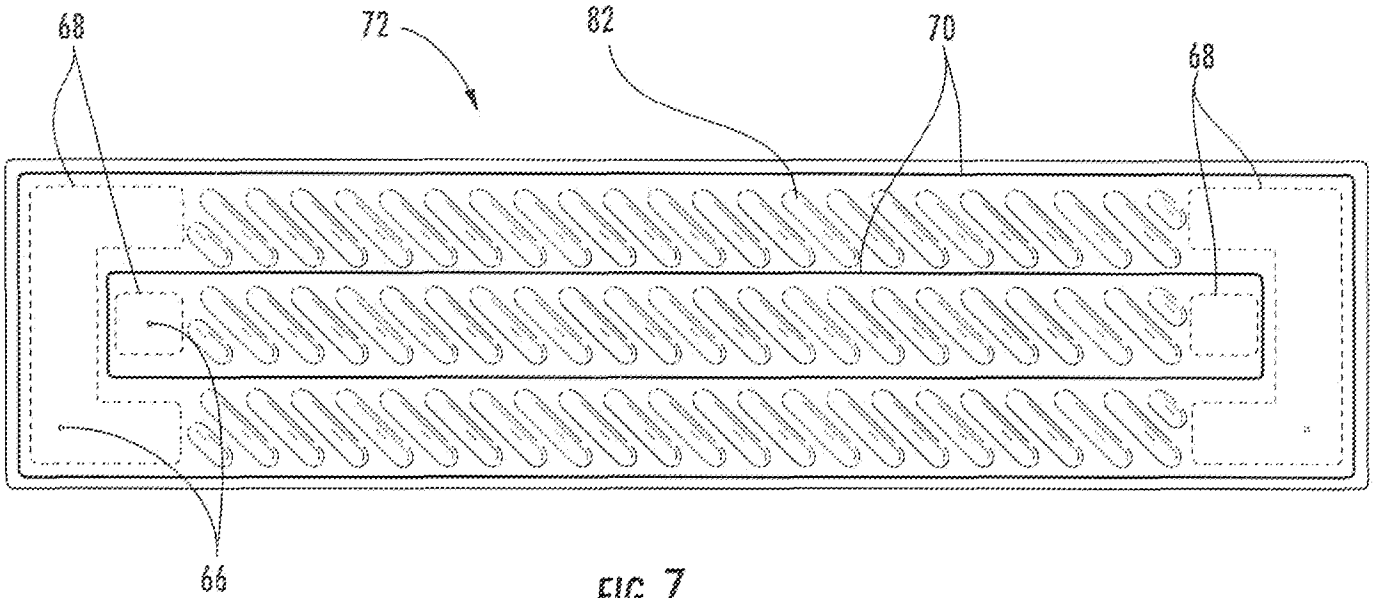
FIG. 7 is a plan view of the blank envelope shown in FIG. 5 shaped into a formed envelope.

FIGS. 6 and 7 provide plan views of the blank envelopes 58 shown in FIGS. 4 and 5, respectively, shaped into formed envelopes 72 by the forming station 42. As shown, each formed envelope 72 includes a corrugated surface 82 and/or turbulators to disrupt the laminar fluid flow inside the formed envelopes 72 and/or through the fluid passages 26. The particular dimensions and shapes of the corrugations and turbulators will vary according to the particular application. For example, the corrugations or turbulators (if present) may have a height of approximately 2.5-10 millimeters. Alternately, the height of the corrugations or turbulators may be approximately ½ of the total thickness of an individual formed envelope 72. In still further embodiments, the height of the corrugations or turbulators may be less than ½ of the total thickness of an individual formed envelope 72 to produce larger fluid passages or channels 26 between adjacent formed envelopes 72.

As shown in FIGS. 6 and 7, the forming station 42 or the assembling station 44 may further cut or otherwise create the fluid channels 68 through opposite ends of each separate volume 60. The fluid channels 68 of adjacent formed envelopes 72 collectively form supply or exhaust headers 84, 86 for each separate volume 60 as well as points for attaching the formed envelope 72 to adjacent formed envelopes 72 in the assembling station 44. In addition, the forming station 42 or the assembling station 44 may separate one formed envelope 72 from another for subsequent assembly into the heat exchanger core 14.

The assembling station 44 generally includes means for assembling a plurality of the formed envelopes 72 into the heat exchanger core 14 shown in FIG. 1. The means for assembling the formed envelopes 72 may include, for example, a drill, saw, punch, or other cutting tool 88 to form the fluid channels 68 and/or separate one formed envelope 72 from another. Alternately or in addition, the means for assembling the formed envelopes 72 may include a brazing machine, soldering machine, welding machine 90, or other device for forming an impermeable barrier 92 around adjacent fluid channels 68.

Figure 8:
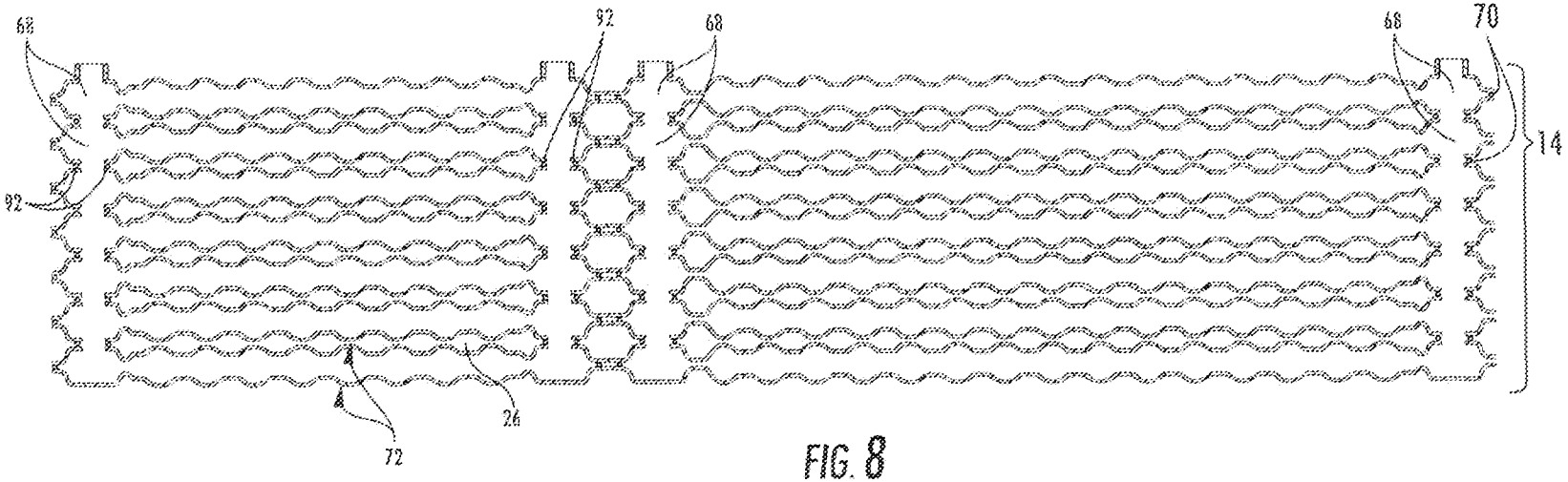
FIG. 8 is a cross-sectional view of the formed envelope shown in FIG. 6 assembled into the heat exchanger core shown in FIG. 1.

FIG. 8 provides a cross-sectional view of formed envelopes 72 shown in FIG. 6 assembled into the heat exchanger core 14 shown in FIG. 1. As shown in FIG. 8, adjacent fluid channels 68 of adjacent formed envelopes 72 are connected together, such as by brazing, soldering, welding, or other conventional methods for forming the impermeable barrier 92 around the adjacent fluid channels 68. Each heat exchanger core 14 may include 100-500 layers of formed envelopes 72, or more or fewer layers of formed envelopes 72 if desired.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for manufacturing a heat exchanger, comprising:

a. joining a first conductive sheet to a second conductive sheet to define a plurality of separate volumes in a blank envelope;

b. creating an aperture in each separate volume in the blank envelope;

c. heating the blank envelope;

d. pressurizing each separate volume through the apertures;

e. hot plastic forming the blank envelope into a formed envelope;

f. creating a fluid channel through opposite ends of each separate volume;

g. assembling a plurality of formed envelopes into a heat exchanger core, wherein the heat exchanger core includes a fluid passage outside of the formed envelopes, wherein the fluid passage is defined by adjacent formed envelopes, and wherein the fluid passage extends across a dimension of the heat exchanger core; and h. connecting adjacent fluid channels of adjacent formed envelopes to allow a different fluid to flow through each separate volume concurrently.

2. The method as in claim 1, wherein the joining comprises at least one of friction stir welding, fusion welding, or laser welding the first conductive sheet to the second conductive sheet.

3. The method as in claim 1, wherein the joining defines a first volume in each blank envelope substantially surrounded by a second volume in each blank envelope.

4. The method as in claim 1, wherein the pressurizing comprises injecting a gas through each aperture and into each volume.

5. The method as in claim 1, further comprising aligning adjacent volumes in each formed envelope parallel to flow through the fluid passage.

6. The method as in claim 1, further comprising aligning adjacent volumes in each formed envelope perpendicular to flow through the fluid passage.

7. A method for manufacturing a heat exchanger, comprising:

a. joining a first conductive sheet to a second conductive sheet to define a plurality of blank envelopes, wherein each blank envelope includes a plurality of separate volumes;

b. separating the blank envelopes;

c. creating an aperture in each separate volume in each blank envelope;

d. heating the blank envelope;

e. pressurizing each separate volume through the apertures;

f. creating a fluid channel through opposite ends of each separate volume;

g. hot plastic forming each blank envelope into a formed envelope;

h. assembling a plurality of the formed envelopes into a heat exchanger core, wherein the heat exchanger core includes a fluid passage outside of the formed envelopes, wherein the fluid passage is defined by adjacent formed envelopes, and wherein the fluid passage extends across a dimension of the heat exchanger core; and i. connecting adjacent fluid channels of adjacent formed envelopes to allow a different fluid to flow through each separate volume concurrently.

8. The method as in claim 7, wherein the joining comprises at least one of friction stir welding, fusion welding, or laser welding the first conductive sheet to the second conductive sheet.

9. The method as in claim 7, wherein the joining defines a first volume in each blank envelope substantially surrounded by a second volume in each blank envelope.

10. The method as in claim 7, wherein the pressurizing comprises injecting a gas through each aperture and into each separate volume.

11. The method as in claim 7, further comprising aligning adjacent volumes in each formed envelope parallel to flow through the fluid passage.

12. The method as in claim 7, further comprising aligning adjacent volumes in each formed envelope perpendicular to flow through the fluid passage.

13. A method for manufacturing a heat exchanger, comprising:

a. joining a first conductive sheet to a second conductive sheet to define a plurality of separate volumes in a blank envelope;

b. creating an aperture in each separate volume in the blank envelope;

c. heating the blank envelope;

d. pressurizing each separate volume through the apertures;

e. hot plastic forming the blank envelope into a formed envelope;

f. creating a fluid channel through each separate volume;

g. assembling a plurality of formed envelopes into a heat exchanger core, wherein the heat exchanger core includes a fluid passage outside of the formed envelopes, wherein the fluid passage is defined by adjacent formed envelopes, and wherein the fluid passage extends across a dimension of the heat exchanger core; and h. connecting adjacent fluid channels of adjacent formed envelopes to allow a different fluid to flow through each separate volume concurrently.

14. The method as in claim 13, wherein the joining defines a first volume in each blank envelope substantially surrounded by a second volume in each blank envelope.

15. The method as in claim 13, wherein the pressurizing comprises injecting a gas through each aperture and into each volume.

16. The method as in claim 13, further comprising aligning adjacent volumes in each formed envelope parallel to flow through the fluid passage.

17. The method as in claim 13, further comprising aligning adjacent volumes in each formed envelope perpendicular to flow through the fluid passage.

* * * * *